US011293630B2

(12) United States Patent
Paul et al.

(10) Patent No.: US 11,293,630 B2
(45) Date of Patent: Apr. 5, 2022

(54) INTERACTIVE TOOL STORAGE SYSTEM

(71) Applicant: snap-on incorporated, Kenosha, WI (US)

(72) Inventors: Rupak Kumar Paul, Williams Bay, WI (US); Ottoleo Kuter-Arnebeck, Kenosha, WI (US); David A. Doerflinger, Racine, WI (US); Benjamin T. Schulz, Oak Creek, WI (US); Nicholas H. Weir, Hoffman, IL (US)

(73) Assignee: Snap-on Incorporated, Kenosha, WI (US)

( * ) Notice: Subject to any disclaimer, the term of this patent is extended or adjusted under 35 U.S.C. 154(b) by 0 days.

(21) Appl. No.: 16/683,638

(22) Filed: Nov. 14, 2019

(65) Prior Publication Data

US 2020/0158318 A1 May 21, 2020

Related U.S. Application Data

(60) Provisional application No. 62/770,322, filed on Nov. 21, 2018.

(51) Int. Cl.
*F21V 23/04* (2006.01)
*B25H 3/02* (2006.01)
(Continued)

(52) U.S. Cl.
CPC ..... *F21V 23/0471* (2013.01); *B25H 3/028* (2013.01); *E05B 47/0002* (2013.01);
(Continued)

(58) Field of Classification Search
None
See application file for complete search history.

(56) References Cited

U.S. PATENT DOCUMENTS 4,178,626 A 12/1979 Marcus
5,246,285 A 9/1993 Redburn et al.
(Continued)

FOREIGN PATENT DOCUMENTS

CN 107571221 A 1/2018
CN 107627281 A 1/2018
(Continued)

OTHER PUBLICATIONS

Combined Search and Examination Report for Application No. GB1916732.9 dated Feb. 28, 2020, 8 pages.
(Continued)

*Primary Examiner* — John F Mortell
(74) *Attorney, Agent, or Firm* — Seyfarth Shaw LLP

(57) ABSTRACT

An interactive tool storage system may include an enclosure with a storage bin and a sensor system configured to detect the interaction of a person with the storage unit. A data acquisition system may collect data from a sensor in the sensor system. The system may include a power module, electric circuit, and data circuit to operably couple the system components. A network interface may enable the input and output of electrical power and data while a data storage system with a writeable memory may collect and record sensor inputs and system outputs. The system may include a non-transitory machine readable memory to store program instructions and a data processor configured to read/write data to the system memory, manipulate data and perform logical operations, interact with sensor system and networked devices; and present a user interface through which the user may interact with the system.

19 Claims, 9 Drawing Sheets

(51) Int. Cl.

| | |
|---|---|
| ***G07C 9/00*** | (2020.01) |
| ***E05B 65/462*** | (2017.01) |
| ***F21V 33/00*** | (2006.01) |
| ***E05B 47/00*** | (2006.01) |
| *F21W 131/301* | (2006.01) |

(52) U.S. Cl.
CPC ..... *E05B 65/462* (2013.01); *F21V 33/0012* (2013.01); *G07C 9/00912* (2013.01); *F21W 2131/301* (2013.01)

(56) References Cited

U.S. PATENT DOCUMENTS

| | | | | |
|---|---|---|---|---|
| 5,459,648 | A | 10/1995 | Courtney | |
| 5,580,155 | A | 12/1996 | Hildebrand et al. | |
| 5,611,170 | A | 3/1997 | McGuff et al. | |
| 5,803,586 | A | 9/1998 | Velez et al. | |
| 6,176,718 | B1 * | 1/2001 | Skarie | H01R 13/64 439/188 |
| 6,203,167 | B1 | 3/2001 | Liu et al. | |
| 6,267,240 | B1 | 7/2001 | Callaway | |
| 6,267,484 | B1 | 7/2001 | Baker et al. | |
| 7,033,040 | B2 | 4/2006 | Spahr et al. | |
| 7,367,685 | B2 | 5/2008 | Moll | |
| 7,657,344 | B2 | 2/2010 | Holmes et al. | |
| 7,847,675 | B1 * | 12/2010 | Thyen | G08B 13/2402 340/5.2 |
| 8,090,473 | B2 | 1/2012 | Higham | |
| 8,449,050 | B2 | 5/2013 | Karg | |
| 8,876,314 | B2 | 11/2014 | Zhu et al. | |
| 8,966,926 | B2 | 3/2015 | Eveland et al. | |
| 9,147,174 | B2 | 9/2015 | Glickman et al. | |
| 9,795,010 | B2 | 10/2017 | Kendall | |
| 2002/0171335 | A1 | 11/2002 | Held | |
| 2005/0062238 | A1 | 3/2005 | Broadfield et al. | |
| 2005/0270770 | A1 * | 12/2005 | Warrender | B60Q 3/225 362/157 |
| 2006/0028820 | A1 | 2/2006 | Fitzsimmons et al. | |
| 2006/0091295 | A1 | 5/2006 | Staples | |
| 2006/0262520 | A1 | 11/2006 | Tress et al. | |
| 2007/0274042 | A1 | 11/2007 | Jackson et al. | |
| 2007/0284945 | A1 * | 12/2007 | Hein | B60Q 3/217 307/10.8 |
| 2008/0180942 | A1 | 7/2008 | Hansen | |
| 2008/0180944 | A1 | 7/2008 | Galvez et al. | |
| 2009/0141486 | A1 | 6/2009 | Migli | |
| 2010/0320890 | A1 * | 12/2010 | Jung | F25D 27/00 312/402 |
| 2013/0208455 | A1 * | 8/2013 | Chung | F21V 33/0012 362/184 |
| 2013/0328661 | A1 * | 12/2013 | Phillips | G07C 9/28 340/5.7 |
| 2014/0350716 | A1 * | 11/2014 | Fly | B65G 1/02 700/215 |
| 2015/0204526 | A1 | 7/2015 | Nilvius et al. | |
| 2016/0022526 | A1 | 1/2016 | Chen et al. | |
| 2016/0313053 | A1 | 10/2016 | Eicher et al. | |
| 2016/0370079 | A1 * | 12/2016 | Park | F25D 11/00 |
| 2017/0115052 | A1 | 4/2017 | Kendall et al. | |
| 2017/0131024 | A1 | 5/2017 | Kempfle et al. | |
| 2017/0136957 | A1 | 5/2017 | Kirtley | |
| 2017/0193189 | A1 * | 7/2017 | Turnell | A61J 7/0427 |
| 2017/0200217 | A1 * | 7/2017 | Huseth | G01C 21/00 |
| 2017/0340112 | A1 | 11/2017 | Miles | |
| 2017/0341217 | A1 | 11/2017 | Cole | |
| 2018/0106439 | A1 | 4/2018 | Dhali et al. | |
| 2018/0293873 | A1 * | 10/2018 | Liu | G06K 7/10366 |

FOREIGN PATENT DOCUMENTS

| | | | |
|---|---|---|---|
| CN | 207139764 | U | 3/2018 |
| CN | 208034635 | U | 11/2018 |
| CN | 109732553 | | 5/2019 |
| CN | 208977741 | U | 6/2019 |
| GB | 2480322 | A | 11/2011 |
| KR | 101615455 | B | 4/2016 |
| TW | 201824204 | A | 7/2018 |
| WO | 2015031563 | A1 | 3/2015 |

OTHER PUBLICATIONS

Taiwan Office Action for Application No. 108142211 dated Nov. 17, 2020, 10 pages.
Australian Examination No. 1 for Application No. 2019268098 dated Oct. 14, 2020, 6 pages.
Examination Report No. 2 for Application No. 2019268098 dated Feb. 26, 2021, 3 pages.
Examination Report for Application No. GB1916732.9 dated Mar. 15, 2021, 3 pages.

* cited by examiner

INTERACTIVE TOOL STORAGE SYSTEM

CROSS-REFERENCE TO RELATED APPLICATIONS

This application claims priority to, and the benefit of, U.S. Provisional Application No. 62/770,322, filed on Nov. 21, 2018, the contents of which are hereby incorporated by reference in its entirety.

TECHNICAL FIELD OF THE INVENTION

The present invention relates generally to storage devices, more particularly to an interactive storage unit for tools and other items.

BACKGROUND OF THE INVENTION

Tool storage units traditionally include an enclosure with one or more storage bins or drawers that are wholly or partially contained within the enclosure. The container may have one or more doors by which all bins or drawers are accessed, known as a locker, or each bin or drawer may be opened and accessed individually. Traditional storage units may have additional features, ornamental or functional, including side trim and wheels. Traditional tool storage systems, however, are passive and inactive. That is, traditional tool storage systems are a non-interactive set of drawers and cabinets with limited functionality to store and secure tools.

SUMMARY OF THE INVENTION

The present invention broadly comprises an interactive tool storage system (ITSS) that may include an enclosure with at least one storage bin or drawer and a sensor system configured to detect the interaction of a person with the storage unit. A data acquisition system may collect sensor data from one or more sensors in the sensor system. The system may include a power module, an electric circuit, and a data circuit to operably couple the system components. A network interface may enable the input and output of electrical power and data while a data storage system with a writeable memory may collect and record sensor inputs and system outputs. The system may include a non-transitory machine readable memory to store defined program instructions and a data processor configured to read/write data to the system memory, manipulate data and perform logical operations, interact with sensor system and networked devices; and present a user interface through which the user may interact with the system.

According to one embodiment, the present invention broadly comprises a tool storage unit having a body, translatable bins disposed in the body, and a sensor disposed on the body. The sensor may be configured to detect an event. A processor may be operably coupled to the sensor and configured to generate an alert upon detection of the event.

According to another embodiment, the present invention broadly comprises an interactive tool storage system including a user interface, a sensor system configured to detect an event associated with a storage unit, a communication module, a power module, and a data processing system coupled to the user interface, the sensor system, the communication module, and the power module. The data processing system may include a processor configured to receive a detection event from the sensor system and generate an alert in response to the detection event. The alert may be transmitted to the communication module.

According to another embodiment, the present invention broadly comprises a tool storage unit including translatable bins and a light source disposed above the translatable bins. A first sensor may be configured to detect movement of at least one the translatable bins. A proximity sensor may be configured to detect the proximity of an object to the tool storage unit. A processor may be configured to generate an alert upon detection of movement of one or more of the translatable bins and an object in proximity to the unit.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF THE INVENTION

Figure 1:
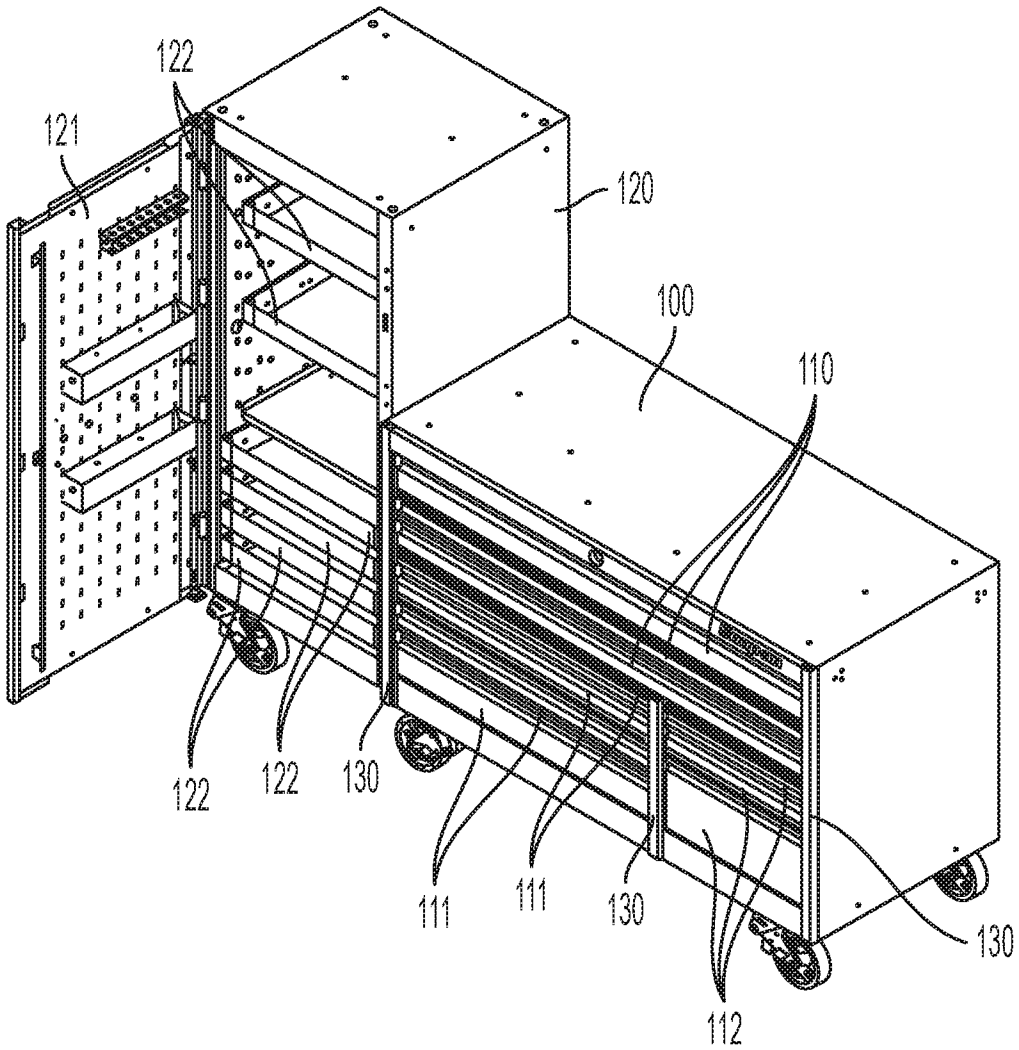
FIG. 1 is a side perspective view of a tool storage unit according to an embodiment of the present invention.

While the present invention is susceptible of embodiments in many different forms, there is shown in the drawings, and will herein be described in detail, embodiments of the invention, including a preferred embodiment, with the understanding that the present disclosure is to be considered as an exemplification of the principles of the present invention and is not intended to limit the broad aspect of the invention to any one or more embodiments illustrated herein. As used herein, the term "present invention" is not intended to limit the scope of the claimed invention, but is instead used to discuss exemplary embodiments of the invention for explanatory purposes only.

The present disclosure presents and describes various aspects of an interactive tool storage system (ITSS) for a tool storage unit. According to an embodiment, the present invention broadly comprises an ITSS including an enclosure with at least one storage bin or drawer that is wholly or partially contained within the enclosure and a sensor system configured to detect the interaction of a person or object with the storage unit. A data acquisition system may collect sensor data from one or more sensors in the sensor system. The ITSS may include a power module, an electric circuit, and a data circuit to connect the system components. A network interface may enable the input and output of electrical power and data while a data storage system with a writeable memory may collect and record sensor inputs and system outputs. The ITSS may include a non-transitory machine readable memory to store defined program instructions and a data processor configured to read/write data to the system memory, manipulate data and perform logical operations, interact with sensor system and networked devices, and present a user interface through which the user may interact with the ITSS. Events detected by the ITSS may be used to send signals that trigger other events on networked devices, such as, for example, alarms, lights, locks, and/or audio/visual media.

The ITSS may include a tool storage unit and an event monitoring response system (EMRS) comprised of sensor systems, data storage and processing systems, input/output (I/O) interfaces, data and power circuitry, power modules, and user interfaces, among other features.

According to another embodiment, the housing of an ITSS may be sized and shaped to fit onto or in a tool storage container, which may be a case-like structure with at least one storage bin or drawer that is wholly or partially contained within the case. For example, the housing for the ITSS may be placed on the façade, mantle, or top of the tool storage unit and in a place where the housing has a line of sight to the drawers or bins or the plane space that the drawers or bins would occupy when opened. That is, the ITSS may be implemented by locating one or more components (e.g., sensors, computation, power module, data storage, network I/O, or the like) within a housing that can be attached to an existing tool storage unit without requiring a re-design of the tool storage unit. As such, the ITSS may exist and function wholly without being attached to a tool storage unit, allowing the ITSS to be fitted or installed to the space above a door portal, on a clothes dresser, or the like.

FIG. 1 depicts an isometric view of a tool storage unit 100 in which the interactive features and an event monitoring and response system (EMRS) may be implemented, according an embodiment of the present invention. The exemplary tool storage unit 100 may include translatable bins, such as drawers 110, 111, 112, that open by translating outwardly and away from the front of the tool storage unit 100. The storage drawers 110, 111, 112 in the tool storage unit 100 may have varying lengths. A side locker 120 may provide another storage location with a door 121 that may open on a hinge to reveal and provide access to one or more storage bins 122. Within the tool storage unit 100, a first set 110, 111 of drawers may be stacked vertically as a drawer bank, and a second set 112 of drawers may form a separate or second bank. The tool storage unit 100 may include side trim 130 bounding the first set 110, 111 of drawers and the second set 112 of drawers. When the door 121 is closed, the façade of the tool storage unit 100 may form a plane with the handles of the first set 110, 111 and second set 112 extending therefrom. It will be appreciated that the number and configuration of the drawers can be modified without changing from the scope and spirit of the present invention.

According to another embodiment, the ITSS may include a sensor system (not shown) configured to detect an event or engagement of a person or object, either physically or via a connected device, with a tool storage unit, such as the exemplary tool storage unit 100 depicted in FIG. 1. According to one aspect, the ITSS may be composed of several subsystems that may include, without limitation, storage locations, an event monitoring and response system (EMRS), and optional tool storage subsystems. The sensor system may detect the engagement and may trigger an action that forms the output of a command to a subsystem or other connected device, as described herein. The engagement may also be recorded in an internal memory.

Figure 2:
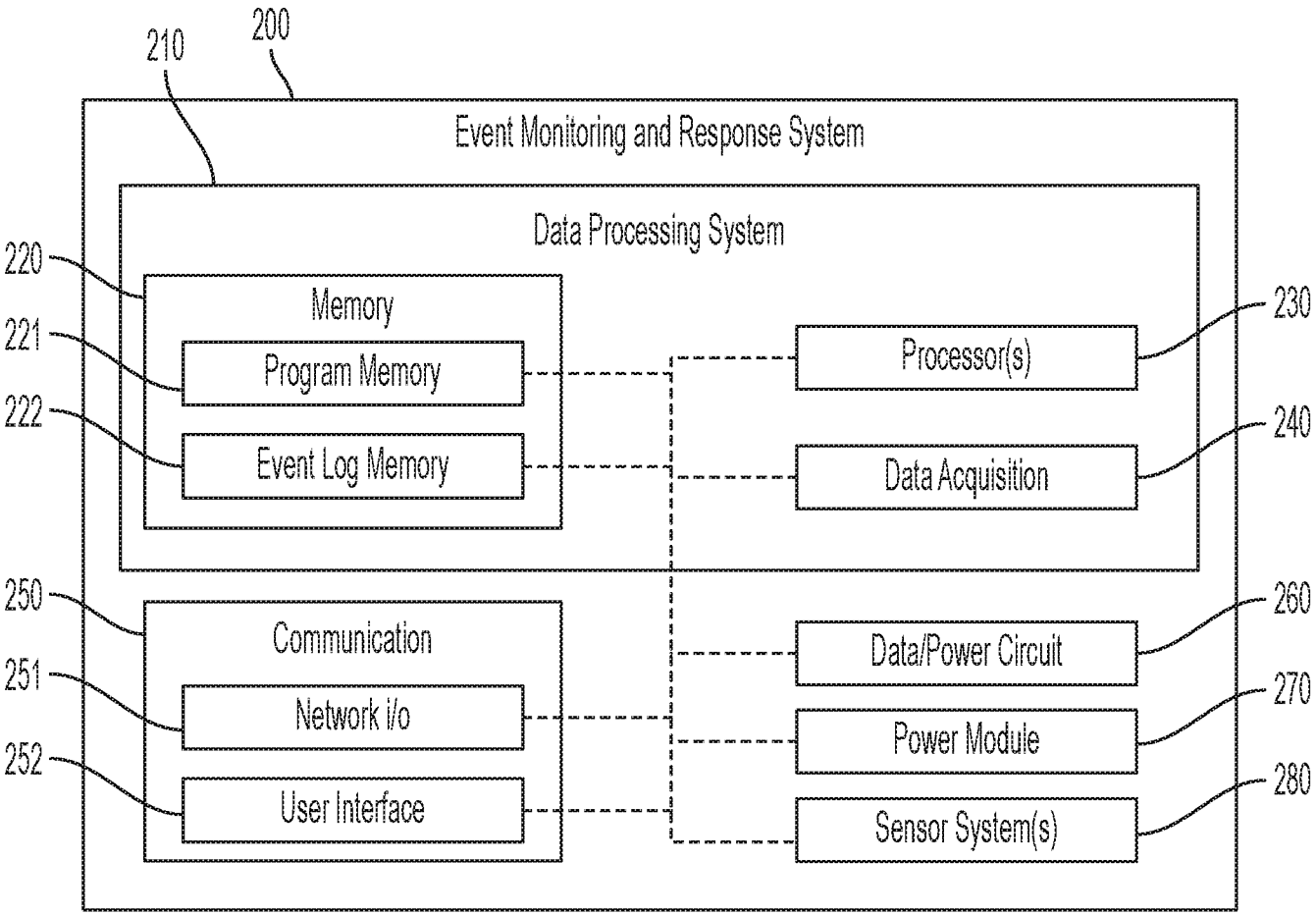
FIG. 2 is a block diagram depicting an architecture of an event monitoring and response system according to an embodiment of the present invention.

Physical interaction with the ITSS may include acoustic or visual (gesture based) communication, for example by speaking commands to the ITSS or by physically entering into a defined area in a space proximate to the ITSS. Examples of physical action may include, without limitation, approaching the ITSS within a certain distance, moving into a certain area, touching the unit, opening a drawer, moving the unit, or speaking audible commands to a microphone in communication with the ITSS. The preceding examples of physical interaction with the ITSS are not meant to be exhaustive and those skilled in the art will recognize other forms of physical interaction may be detected by sensors FIG. 2 depicts an architecture of an event monitoring and response system (EMRS) 200, a subsystem of the ITSS, according to one aspect of the present disclosure. The EMRS 200 may include a data processing system 210, a communication module 250, a data/power circuit 260, a power module 270, and sensor system(s) 280.

According to one aspect, the sensor system 280 may include one or more sensors and may be configured to detect the position, motion or other interaction of the bins or drawers relative to the unit. According to another aspect, the sensor system 280 may be configured to detect the proximity or presence of a person or object, such as a fob or other device, accessing the unit. The sensor system 280 may also be configured to detect the audible commands of a person interacting with the unit and/or to detect the translation of the entire unit relative to a static self-referenced state or a geostationary state. The sensor system 280 may combine some or all of the previously described sensor system configurations.

A sensor or other detection element of the sensor system 280 may include non-contact type sensors (e.g., Infrared sensors, laser range finders, optical gate switches, sonars, microphones, hall effect sensors, magnetic reed switches, tunneling magnetic resistance, radio frequency (RF), wi-fi, Bluetooth, RFID, or the like) and/or contact sensors (gyroscopes, accelerometers, capacitance, push/pull switches, or the like). The motion and/or position sensors may be located within the unit and may not be visible from outside. For example, a printed circuit board (PCB) with embedded tunneling magnetic resistance (TMR) sensors may be affixed to the interior back or interior side of the unit and detect the motion of a magnet that has been affixed to a drawer. A RF receiver/transmitter also may be configured to detect a RF transponder that is placed within a drawer that becomes communicable with the receiver/transmitter when the drawer is open and the RF transponder enters the communication line of sight of the receiver/transmitter. In one configuration, a sensor board may be placed into the exterior vertical trim and configured to detect a magnet that is affixed to the side of the drawer when the drawer is opened and translated past the trim housing, the TMR sensor, a Hall Effect sensor or a reed switch.

According to an embodiment, sensors to detect a drawer-opening event may also be implemented by placing a single or multiple optical range finding sensors or acoustic range finding sensors aiming down from the top of the unit to detect the drawer opening by registering a new distance reading. A laser emitter and detector also may be placed on the outside of the unit, on opposing sides, aimed either vertically or horizontally which may be configured to detect an interruption in the line of sight when the drawer is opened. Single or multiple inertial measurement sensors may also be used in or on the unit to detect an impulse that is applied to the structure when a drawer is opened.

According to an embodiment, sensors configured to detect the presence of a person or object interacting with the tool storage unit may include optical range finding sensors or acoustic range finding sensors placed in the front of the unit. The sensors may be aimed approximately horizontally outwardly away from the tool storage unit to detect the approach and presence of a person or object. Additionally, sensors configured to detect human interaction with the tool storage unit may include a microphone to receive audio commands and/or radio frequency (RF) antennae disposed on the exterior of the unit that may detect the presence and proximity of an RF tag worn by the user.

A data processing system 210 may be in operable communication with the sensor system 280 of the EMRS 200. The data processing system 210 may include a memory 220, one or more processors 230, and a data acquisition module 240. The memory 220 may include, at least, a non-transitory machine-readable recording medium that stores a program defining functional logic algorithms. A first memory partition may include a program memory 221 storing the program code, a set of instructions that governs the operation of the EMRS 200 and which is readable and executable by the processor 230. The memory 220 may include a second read/write memory, event log memory 222, for storing event log data, user profiles, user settings or other data. The event log memory 222 may be a readable and writeable memory bank. The event log memory 222 may be used to record user program settings, user profiles, connected device profiles, password encryption, event data, error data, software application executable files, and/or other data. Event data may include, for example, a detected drawer open event, time of event and associated statistics, sensor metadata, internet protocol (IP) addresses of connected devices, audio/visual data, or the like.

The processor 230 may include instructions to manipulate the sensor data and other data saved in the memory 220. The processor 230 may also make decisions and trigger resulting events based on the data received and analyzed. The processor 230 may be configured to interact with, receive commands from, and send control commands to other elements in the EMRS, such as the power module 270 and the user interface 252. The processor 230 may also be configured to interact with systems existing as modular add-ons to the tool storage system, for example lights, locks, and security alarms.

The processor 230 may interact with external devices adding functionality to the unit. Examples of added functionality may include, without limitation: turning on a light to illuminate a particular drawer when that drawer is detected to be in an opened state, actuating a lock to an unlocked position upon detecting the proximity of a user or object, blinking the lights when the user activates the lock, actuating the lock on the unit to a locked position when the user leaves a prescribed proximity zone, turning on a colored night light when the box is locked, activating an audio/visual system when registering a voiced command by the user, or sending data to a networked data repository or cloud network data storage when the read/write memory is full. The processor 230 may also be configured to interact with systems existing on an external network, for example cellular phones, diagnostic equipment, computer systems, cloud data storage, and/or battery chargers, to provide additional functionality. Such additional functionality may include, without limitation, storing data from other tool systems and diagnostic equipment, accessing data and relaying the data to the user by audio/visual indicators, querying tool battery state of charge and relaying information to user by audio/visual indicators, and sending and receiving data and instructions to and from cellular phone software applications. Further, the system may send and receive power to and from other functional features, for example powering lights, locks, or switching relays or receiving supplementary power from a battery.

The data processing system 210 may be operably coupled to an external network via a communication module 250 using a wired connection or wireless data transfer protocol, such as, for example, RF, Wi-Fi, Bluetooth, or the like. The communication module 250 may be composed of a network input/output (I/O) 251 and a user interface 252. The network I/O 251 may be a hard-wired (e.g., fiber optic, ethernet cable, local area network) connection port or a wireless transmission method (e.g., Wi-Fi, Bluetooth, RF). The user interface 252 may be a hard-wired box with a switch to toggle between preset program functions, for example, a switch allowing the user to turn on/off the ITSS and interact with connected devices/systems. According to one aspect, interacting with connected devices or systems may include actuating lights and locks, selecting lighting colors, selecting lighting magnitude, setting timers for lights, activating/deactivating alarms, downloading and uploading data to and from the network, and/or setting detection threshold sensitivity. In an embodiment, the user interface 252 may be an operably coupled device such, for example, as a personal computer or mobile device running a software application that interacts with the data processing system 210 of the EMRS 200.

A data/power circuit 260 may operably couple one or more of the systems. Each circuit may have input/output capability. The data/power circuit 260 may allow the system to be operably coupled to supplemental battery power and to power other ancillary devices such as, for example, battery chargers, lights, audio/visual systems, locks, computers, diagnostic tools.

Figure 3A:
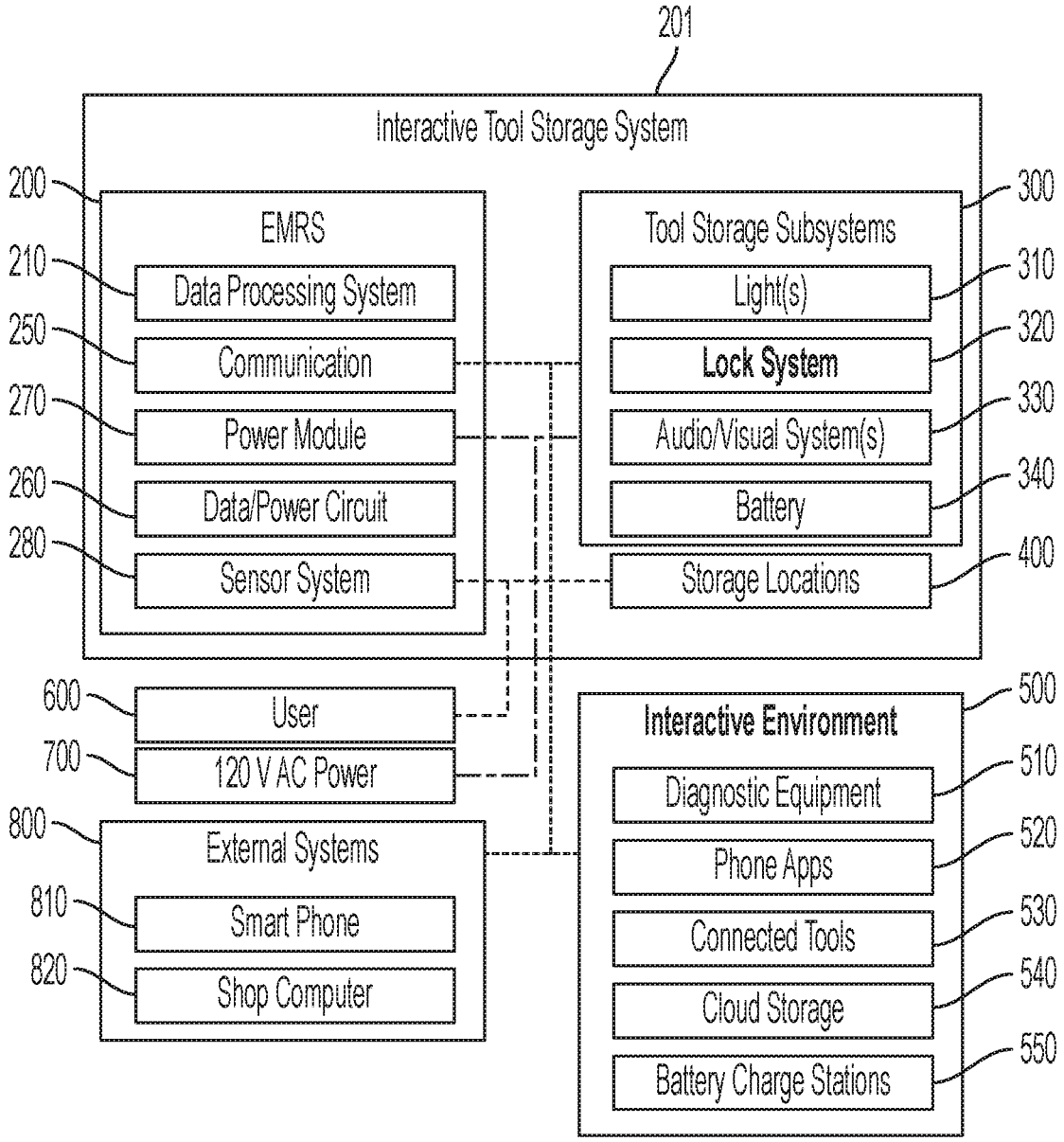
FIG. 3A is a block diagram depicting an architecture of an interactive tool storage system according to an embodiment of the present invention.
Figure 3B:
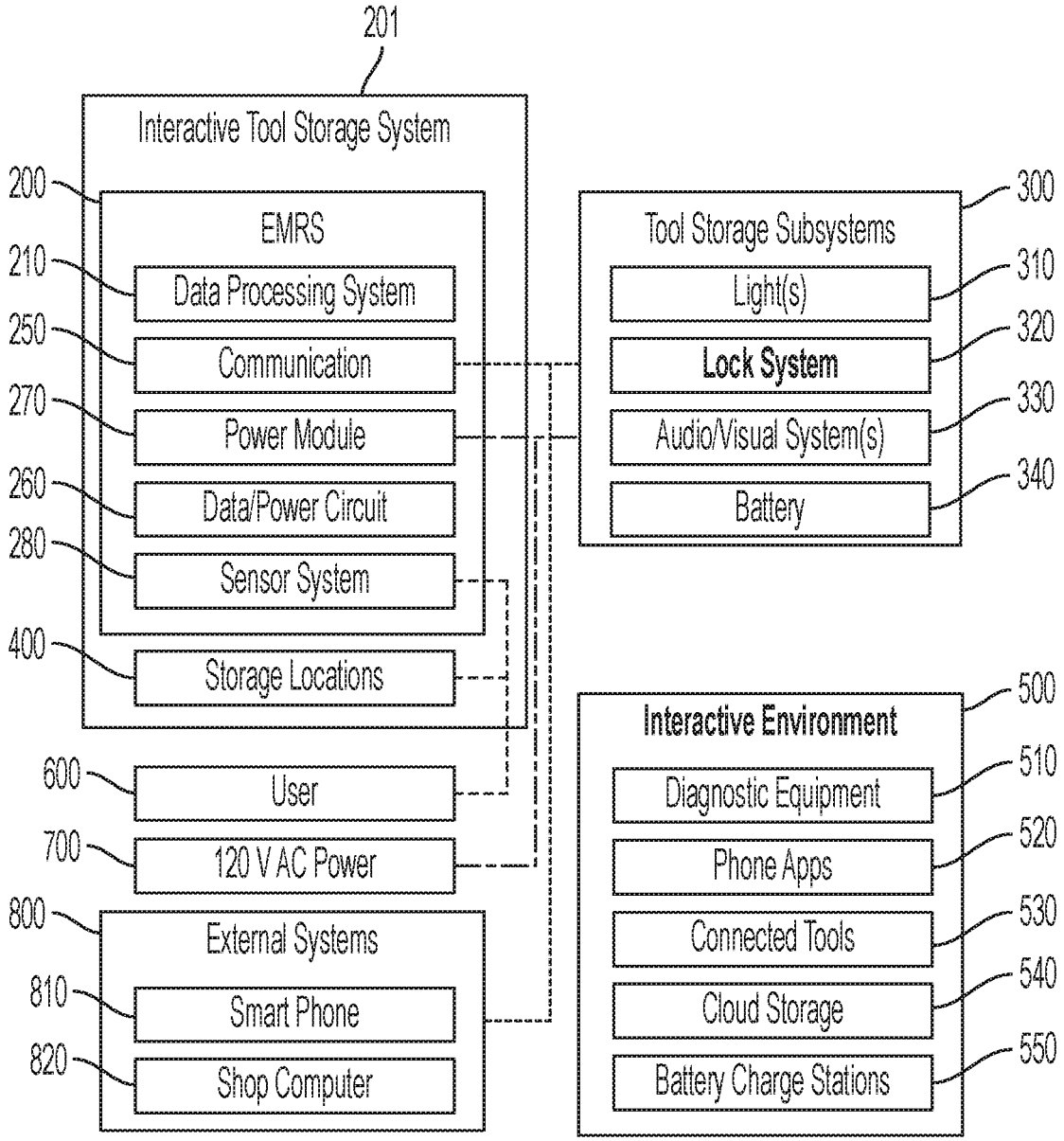
FIG. 3B is a block diagram of an alternative architecture of an interactive tool storage system according to an embodiment of the present invention.
Figure 3C:
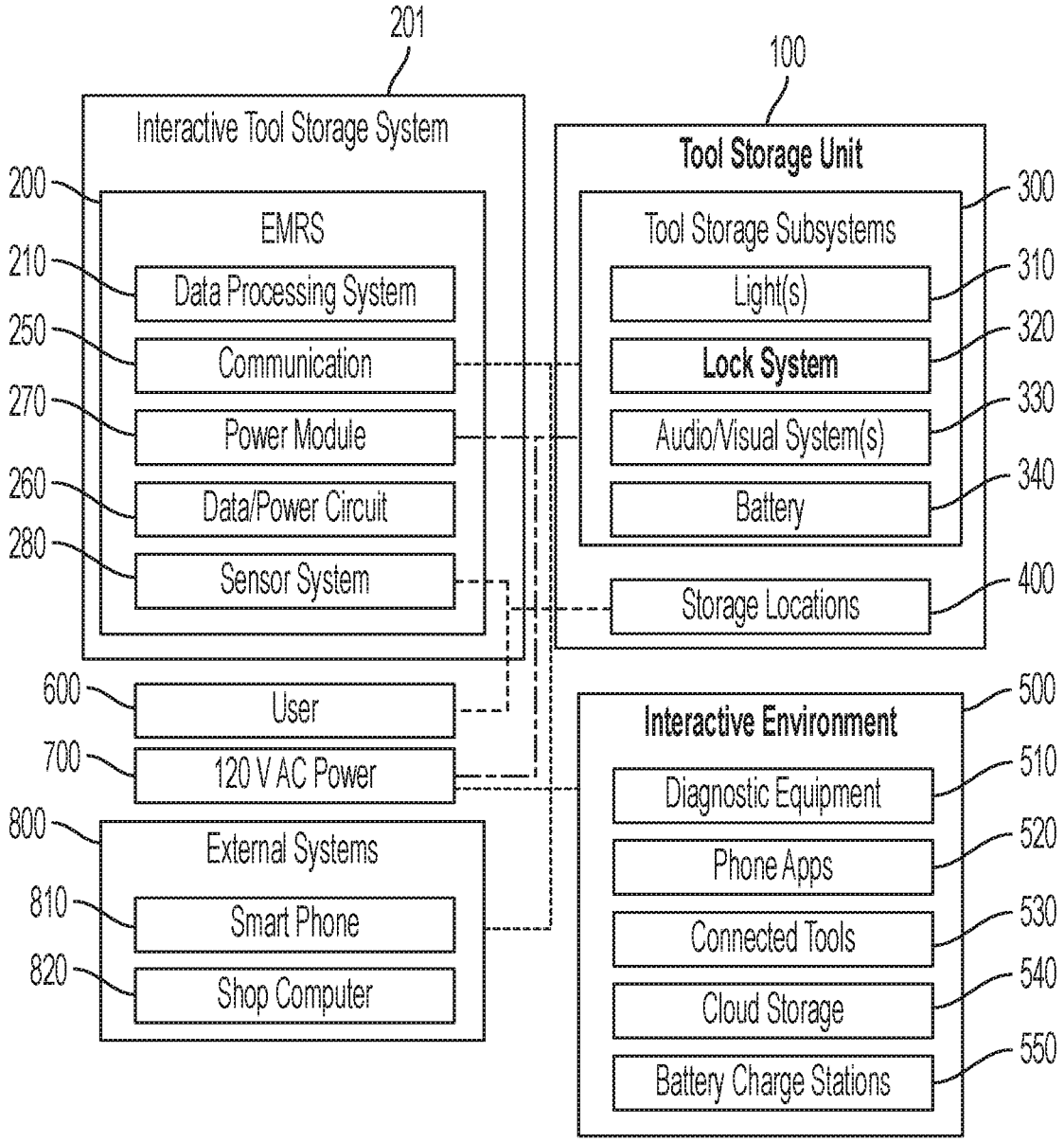
FIG. 3C is a block diagram of yet another alternative architecture of an interactive tool storage system according to an embodiment of the present invention.

FIGS. 3A-C depict various architectures of an ITSS 201, according to one or more embodiments. FIG. 3A depicts an architecture of an ITSS 201 which may include an EMRS 200, storage locations 400, and tool storage subsystems 300. The tool storage subsystems 300 may include light modules 310, a lock system 320, such as, for example, ECKO™ Locks from Snap-on Incorporated, or other local or remote locking mechanisms, audio/visual systems 330, and batteries 340. According to another embodiment, as shown in an alternative architecture of FIG. 3B, the ITSS system 201 may provide for the storage locations 400, the EMRS 200, and the tool storage subsystems 300 located outside of the immediate vicinity of the ITSS. That is, such components may not be physically co-located with the ITSS 201.

According to another embodiment, as shown in a further alternative architecture of FIG. 3C, the ITSS 201 may include only the EMRS 200 which interacts with a traditional tool storage unit 100 as an add-on functionality. Considering the deployment of the ITSS depicted in FIG. 3C, the tool storage subsystems 300 and the storage locations 400 may exist on a traditional tool storage unit 100 while the ITSS 201 interacts communicatively with the other systems to power and trigger events in those systems based on configuration and settings of the EMRS 200. The connectivity of the ITSS and ancillary systems is depicted by the dotted and dashed lines in FIGS. 3A, 3B, and 3C. In all of the embodiment described and depicted in FIGS. 3A, 3B, 3C, the functionality, systems, features, and connectivity of the tool storage subsystems 300 of the ITSS 201 may be substantially the same.

Other systems existing outside of the ITSS 201 may be arranged similarly with respect to operable coupling and interaction with any of the systems described and depicted in FIGS. 3A, 3B, and 3C. Such systems may include, for example, a user 600, a 120V AC power 700, or other power source, external systems 800, and an interactive environment 500. The interactive environment 500 may include, but is not limited to, diagnostic equipment 510, phone or mobile device apps 520, connected tools 530, cloud storage 540, and/or battery charge stations 550.

According to an embodiment, the power module 270 of the ITSS 201 may send and receive power to and from the sub-system components. The power module 270 may further collect and output data to and from the sub-system components. For example, the power module 270 may cause the lock system 320 to actuate to a locked or unlocked position when the user 600, or an object such as a fob, enters or leaves a defined proximity of the ITSS 201 as detected by the sensor system 280. The lock system 320 may include a powered lock with an RF communication protocol that connects a remote switch to actuate the lock per user command.

The interactivity outside of the internal network of the ITSS 201 allows the ITSS 201 to connect to a battery 340 to run on-board systems or to charge the battery 340 if the ITSS 201 is connected to the 120V AC power 700.

According to an embodiment, the ITSS 201, and in particular the EMRS, may allow the system to display information on an audio/visual system 330. For example, the audio/visual system 330 may display or otherwise indicate, without limitation, the status of charge of a connected battery charge station 550 or connected tool 530, play audio, display the time, display a logo, sound an alarm, and/or send or receive data from a shop computer 820.

According to an embodiment, interactivity outside of the internal network of the ITSS 201 may provide for the actuation of light modules 310 based on interpretation of sensor data. The EMRS 200 may detect interactivity of the user 600, such as, for example, the user's proximity or motion of the storage locations 400 and cause the light modules 310 to turn on/off, change color, intensity, blink, or flash in a pattern, for example.

The EMRS 200 may function as an intermediary device between other external systems 800 and optional features or devices existing in the interactive environment 500. Accordingly, the EMRS 200 may link or pair with operably coupled systems and devices that exist in the interactive environment 500 through the communication module 250 and lock such devices to the identification of the ITSS 201. For example, a user 600 may be required to know or possess a password or key to unlock the tool storage unit 100 equipped with the ITSS 201 to use other operably coupled or paired devices and systems. Operably coupled and paired devices may utilize the data processing system 210, for example, to store information, make computations, download data, install programs, and generate or issue prompts. For example, generating prompts from connected and paired devices in the interactive environment 500 may include a mobile device app 520 running on a connected smart phone 810 that may prompt the data processing system 210 of the EMRS 200 to check for local networks, to calibrate the sensor system 280, or to charge batteries 340.

Figure 4:
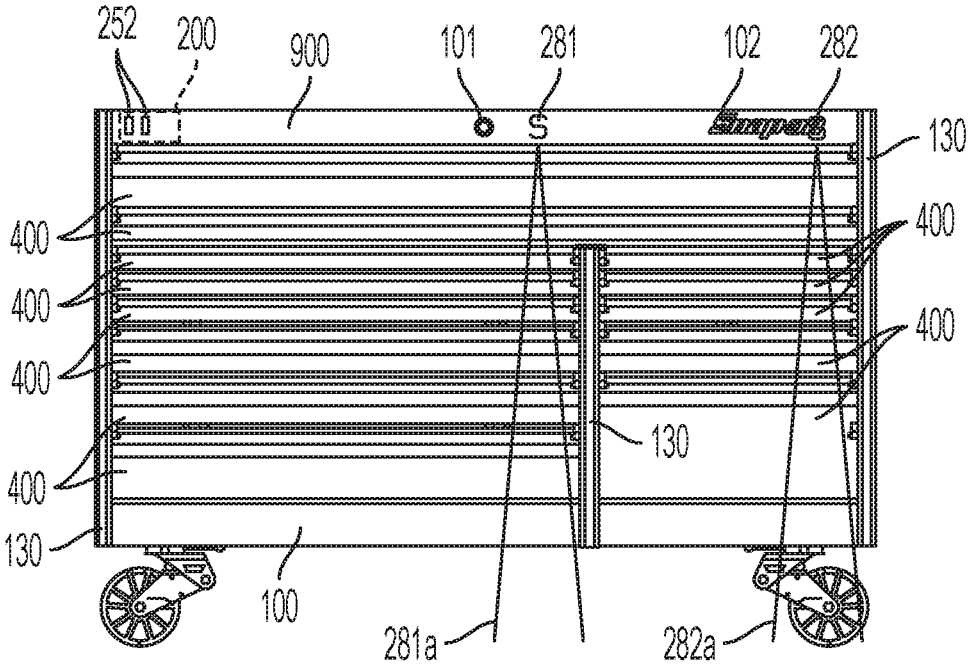
FIG. 4 is a front plan view of a tool storage unit according to an embodiment of the present invention.

According to an embodiment, the ITSS 201 may be housed completely within the structure of a tool storage unit 100 as depicted in FIG. 4. In FIG. 4, the tool storage unit 100 is shown as outfitted with multiple banks of storage locations 400—i.e., translatable drawers, bins or trays. The EMRS 200 and the user interface 252 of the ITSS 201 may be disposed in the upper left corner, and sensors 281, 282 may be functionally disposed across the top of the unit 100. Other features of the tool storage unit 100 of FIG. 4 may include a logo 102, side trim 130, and a lock emboss 101. In the exemplary system of FIG. 4, the sensors 281, 282 may be optical (laser range finding or infrared) or acoustic non-contact sensors. Each sensor 281, 282 may generate a cone of visibility 281*a*, 282*a* aimed downward from the sensors' locations at the top of the façade or dress plate 900. According to an embodiment, a sensor 281, 282 may be provided for each bank of storage locations 400.

Figure 5:
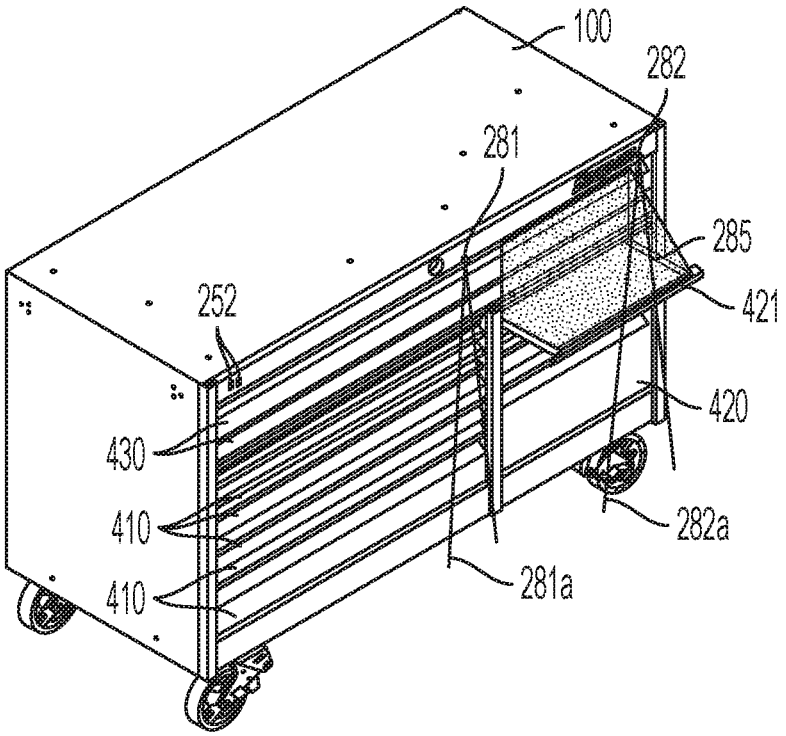
FIG. 5 is a side perspective view of a tool storage unit according to an embodiment of the present invention.

FIG. 5 depicts a tool storage unit 100 including an ITSS with multiple sensors. According to an embodiment, in operation, a first sensor 282 may see or otherwise detect an opened drawer 421 in the right drawer bank 420. The opened drawer 421 may interrupt the cone of visibility 282*a* of the first sensor 282. The first sensor 282 may determine that the drawer 421 is open by measuring a new distance 238 (between the height of the first sensor 282 and the opened drawer 421) relative to the static floor distance measurement (i.e., the distance measured from the first sensor 282 to the floor).

In the embodiment depicted in FIG. 5, the EMRS 200 (not shown) may interpret the sensor data and output a signal commanding a light (not shown) to illuminate an area 285. In this case, the data processing system 210 may recognize that the sensor 282 has detected an event, and, based on the configuration and settings, send a signal to illuminate a particular light module corresponding to the location of the registering sensor 282. The location of the drawer bank 420 corresponding to the location of the sensor 282 may be illuminated while other banks 430, 410 are not illuminated because none of those drawers are opened and detected by sensor 281. If a second drawer 430 is opened, then a second sensor 281 may register a new distance and the EMRS 200 will cause the lights to illuminate both drawers. Likewise, if a storage location 410 is opened, then only the cone of visibility 281*a* of the second sensor 281 is interrupted and the EMRS 200 can instruct the light on the left side of the box to illuminate. According to an embodiment, the sensors 281, 282 or additional sensors may be configured to aim orthogonal to the unit façade and detect the approach of a person by a ranging method and cause the lights to illuminate when the user reaches a certain distance from the front of the unit.

According to an embodiment of the EMRS 200, the sensor system 280 may be an inertial measurement unit (IMU) such as a gyroscope or an accelerometer configured to detect the motion of the tool storage unit 100. It will be appreciated that the sensor system 280 may be any combination of the aforementioned sensor types, locations, and configurations.

According to an embodiment, the EMRS 200 may collect data from the sensor system 280, process the data, and determine that a particular drawer 421 is open based on the distance measured by the sensors 281, 282 being closer than the floor. That determination may cause a signal to be sent to the appropriate light module 312 to illuminate the drawer 421. Some other obstruction may have been moved in front of and in close proximity to the tool storage unit such that the obstacle is detected by the sensors 281, 282. The detection by the sensors 281, 282 of an obstacle of approximately the same height as the storage location 400 locations may constitute a false positive and the EMRS 200 would send the signal to illuminate the light modules 312, 311. In such a circumstance, if the ITSS included an inertial measurement unit in the sensor system 280, the EMRS 200 may be able to determine that a drawer had not been opened because no impulse would be administered to the tool storage unit 100 by the detected obstacle. If the obstacle did contact the tool storage unit 100 and register an impulse, the processor 230 may be instructed to recognize the difference between an impact impulse and the change of inertia incurred by the opening of a storage location 400. For example, impact impulses excite inertial measurement at one or more resonance frequencies, whereas a cyclical force or transient force would be registered at a different frequency bandwidth by an inertial measurement sensor.

Figure 6A:
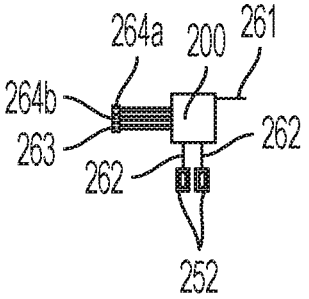
FIG. 6A is a side view of system light modules according to an embodiment of the present invention.
Figure 6B:
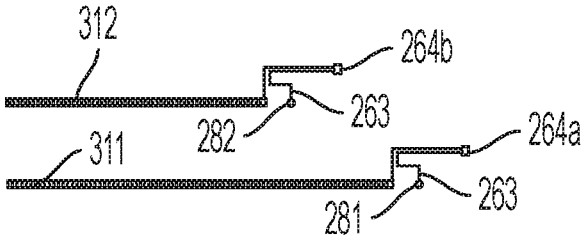
FIG. 6B depicts an event monitoring and response system according to an embodiment of the present invention.

FIGS. 6A-B depict an embodiment of hardware of an ITSS lighting system. The EMRS 200 (FIG. 6A) may receive power from the power/data connection 261 and may be operably coupled to the user interface 252 by power/data connections 262. The EMRS 200 may be operably coupled to the sensors 281, 282 by the power/data connection 263 and is operably coupled to the light modules 311, 312 (FIG. 6B) by the power/data connections 264*a*, 264*b*. In certain aspects, the power/data connections 264*a*, 264*b* may send data only if the light modules 311, 312 have a unique power source. In certain aspects, the light modules 311, 312 may have a unique microcontroller unit (not shown) to regulate power and switch the light on and which function as a slave controller to the EMRS 200 controller.

FIG. 6A depicts light modules 311, 312 of differing dimensions. The dimensions of the lights may be configured to match the dimensions of the particular drawer bank to be illuminated. In a case where a drawer may extend across one or more drawer banks, the EMRS 200 both sensors 281, 282 may detect and register a drawer open event and send a signal to illuminate both light modules 311, 312.

According to an embodiment, the user interface 252 may be one or more switches. The function of the switches in the user interface 252 may be, for example, to select among a list of settings, configurations or program instructions that govern the functionality of the processor 230. For example, the switches of the user interface 252 may be programmed to: deactivate the light sensors, turn the lights on persistently, switch off the ITSS, change the light intensity level, change the light illumination color, initiate a timer to turn off the illumination after a drawer event is detected, blink or change a light color after a certain time has elapsed with the drawer open, and/or set an alarm. According to an embodiment, the user interface 252 may be a contact-sensitive switch that resides behind a logo 102 making the logo 102 effectively the user interface.

According to an embodiment, the EMRS modules may be located in a dress plate 900 (FIG. 4) on the façade of the tool storage unit 100. The dress plate 900 may be attached permanently or removable to the tool storage unit 100.

It will be appreciated that the tool storage unit 100 and the ITSS 201 depicted in FIGS. 4-6B are illustrative only of certain configurations and operations of the ITSS. In other contemplated configurations, the sensor system 280 may be disposed in the side trim 130 and aimed horizontally to detect the motion of the storage locations 400. In such a configuration, the sensors may be placed in the trim 130 and may be reactive to a magnetic field through detection of a magnet affixed to the storage location 400. A sensor reactive to a magnetic field may include, for example, a Hall Effect sensor, a tunneling magnetic resistance sensor, a reed switch, or the like.

Figure 7:
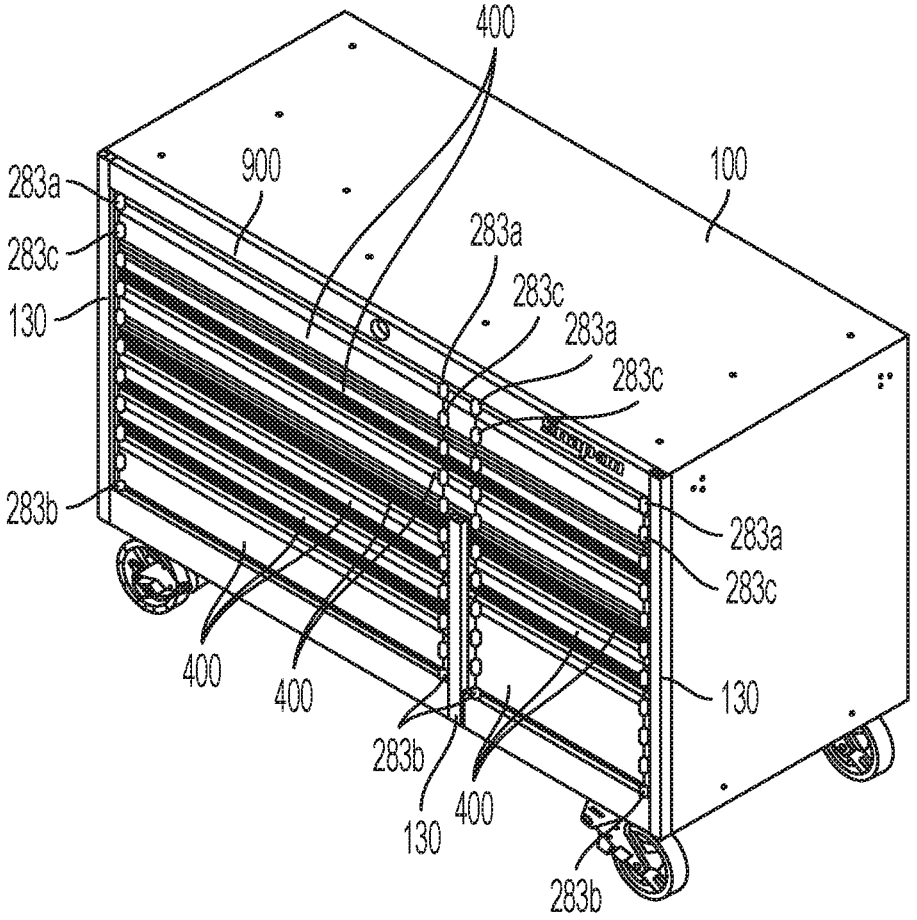
FIG. 7 is a side perspective view of a tool storage unit according to an embodiment of the present invention.

According to an embodiment, as depicted in FIG. 7, optical gate switch-type sensors may detect a broken beam when the drawer is translated through the gate. In such a configuration, the sensor system 280 may be composed of photo-interrupter type sensors 283*a*, 283*b*, also known as gate switches. When the line of sight 283*c* between sensor 283*a* and sensor 283*b* is broken, the EMRS 200 may determine which bank of drawers is open and generate an appropriate output. In another aspect, the photo-interrupter type sensors 283*a*, 283*b* may be disposed in the trim 130 and aimed substantially horizontally across the width of the unit or drawer banks.

Figure 8:
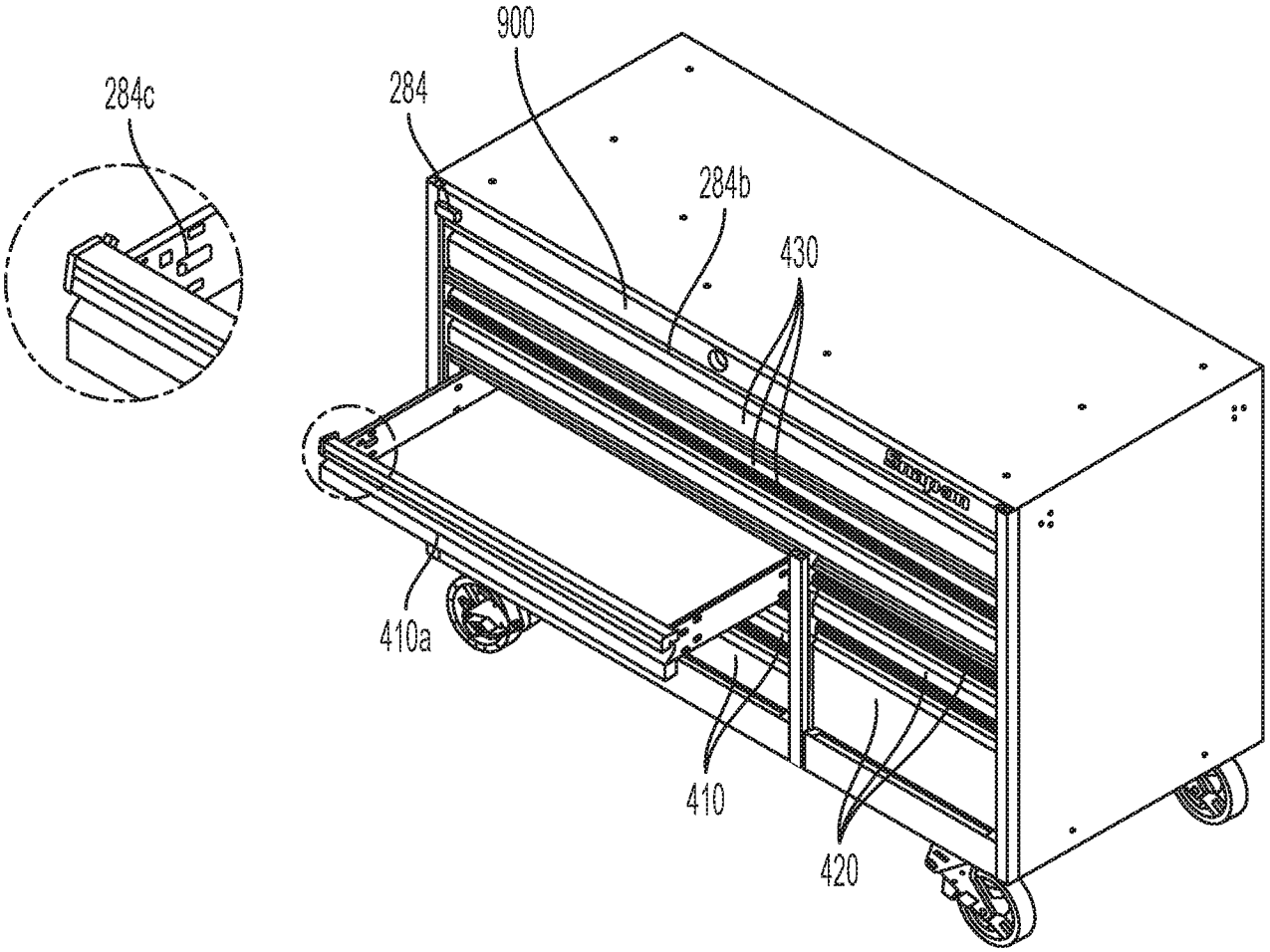
FIG. 8 is a side perspective view of a tool storage unit with one of the drawers open according to an embodiment of the present invention.

In another embodiment, depicted in FIG. 8, the sensors may be an RF emitter and detector 284 that may send and receive a signal by antenna 284*b* to excite the passive RF ID tag 284*c* that may be placed in or on a drawer 410*a*. Each storage location 400 or each drawer bank 410, 420, 430 may have a unique RF ID tag affixed to each drawer. In another embodiment, the sensor 284 may be configured to excite and detect a passive RF ID tag that is affixed to a user or a mobile device. In another aspect, the dress plate 900 may be used as an antenna.

Figure 9A:
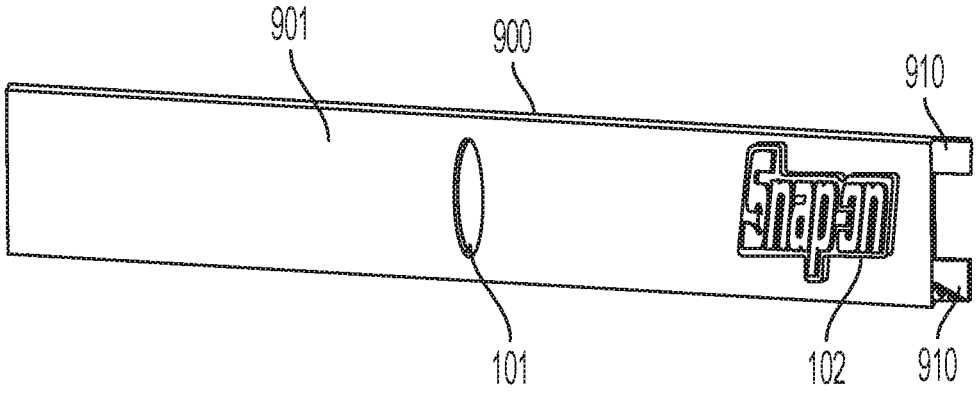
FIG. 9A is a perspective front view of a dress plate housing according to an embodiment of the present invention.
Figure 9B:
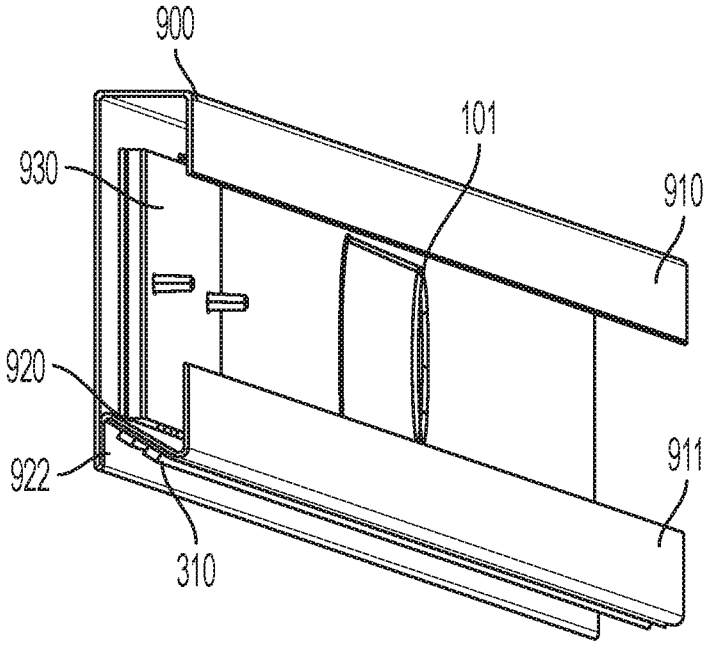
FIG. 9B is a perspective rear view of the dress plate housing of FIG. 9A, according to an embodiment of the present invention.

Referring to FIG. 3C, the ITSS 201 may be a standalone unit independent of the tool storage system and optional additional features of the tool storage system. The ITSS 201 may be housed within a special housing, such as a dress plate 900. FIGS. 9A-B show a housing 901 that can be attached to the façade of the tool storage unit 100. FIG. 9A depicts a front view of the housing 901, while FIG. 9B depicts a rear view. The housing 901 may include features such as top tab 910 and bottom tab 911 that are formed as coupling structures allowing the housing 901 to be fixed to the tool storage unit 100 by adhesive, welding, screw, rivet, friction-fit, or other coupling method. The bottom tab 911 may be formed with a bend 920 that provides a mounting point for sensors (not shown) and light modules 310. The bend 920 serves to aim the light modules 310 and sensors downward toward the areas of interest on or around the unit. The bend 920 may start above an edge 922 such that the sensors and light modules 310 are slightly shielded. In an embodiment, the angle of the bend 920 may be preferably between 20 degrees to 70 degrees measured from the edge 922. The back of the housing 901 may include or define a rectangular enclosure 930 that may be used to house the components of the EMRS 200 such as the data processing system 210, the communication module 250, the power module 270 and aspects of the sensor system 280.

The various illustrative logical blocks, modules and circuits described in connection with the present disclosure may be implemented or performed with a processor specially configured to perform the functions discussed in the present disclosure. The processor may be a neural network processor, a digital signal processor (DSP), an application specific integrated circuit (ASIC), a field programmable gate array signal (FPGA) or other programmable logic device (PLD), discrete gate or transistor logic, discrete hardware components or any combination thereof designed to perform the functions described herein. Alternatively, the processing system may comprise one or more neuromorphic processors for implementing the neuron models and models of neural systems described herein. The processor may be a microprocessor, controller, microcontroller, or state machine specially configured as described herein. A processor may also be implemented as a combination of computing devices, e.g., a combination of a DSP and a microprocessor, a plurality of microprocessors, one or more microprocessors in conjunction with a DSP core, or such other special configuration, as described herein.

The steps of a method or algorithm described in connection with the present invention may be embodied directly in hardware, in a software module executed by a processor, or in a combination of the two. A software module may reside in storage or machine readable medium, including random access memory (RAM), read only memory (ROM), flash memory, erasable programmable read-only memory (EPROM), electrically erasable programmable read-only memory (EEPROM), registers, a hard disk, a removable disk, a CD-ROM or other optical disk storage, magnetic disk storage or other magnetic storage devices, or any other medium that can be used to carry or store desired program code in the form of instructions or data structures and that can be accessed by a computer. A software module may comprise a single instruction, or many instructions, and may be distributed over several different code segments, among different programs, and across multiple storage media. A storage medium may be coupled to a processor such that the processor can read information from, and write information to, the storage medium. In the alternative, the storage medium may be integral to the processor.

The methods disclosed herein comprise one or more steps or actions for achieving the described method. The method steps and/or actions may be interchanged with one another without departing from the scope of the claims. In other words, unless a specific order of steps or actions is specified, the order and/or use of specific steps and/or actions may be modified without departing from the scope of the claims.

The functions described may be implemented in hardware, software, firmware, or any combination thereof. If implemented in hardware, an example hardware configuration may comprise a processing system in a device. The processing system may be implemented with a bus architecture. The bus may include any number of interconnecting buses and bridges depending on the specific application of the processing system and the overall design constraints. The bus may link together various circuits including a processor, machine-readable media, and a bus interface. The bus interface may be used to connect a network adapter, among other things, to the processing system via the bus. The network adapter may be used to implement signal processing functions. For certain aspects, a user interface (e.g., keypad, display, mouse, joystick, etc.) may also be connected to the bus. The bus may also link various other circuits such as timing sources, peripherals, voltage regulators, power management circuits, and the like, which are well known in the art, and therefore, will not be described any further.

The processor may be responsible for managing the bus and processing, including the execution of software stored on the machine-readable media. Software shall be construed to mean instructions, data, or any combination thereof, whether referred to as software, firmware, middleware, microcode, hardware description language, or otherwise.

In a hardware implementation, the machine-readable media may be part of the processing system separate from the processor. However, it will be appreciated that the machine-readable media, or any portion thereof, may be external to the processing system. By way of example, the machine-readable media may include a transmission line, a carrier wave modulated by data, and/or a computer product separate from the device, all which may be accessed by the processor through the bus interface. Alternatively, or in addition, the machine-readable media, or any portion thereof, may be integrated into the processor, such as the case may be with cache and/or specialized register files. Although the various components discussed may be described as having a specific location, such as a local component, they may also be configured in various ways, such as certain components being configured as part of a distributed computing system.

The machine-readable media may comprise a number of software modules. The software modules may include a transmission module and a receiving module. Each software module may reside in a single storage device or be distributed across multiple storage devices. By way of example, a software module may be loaded into RAM from a hard drive when a triggering event occurs. During execution of the software module, the processor may load some of the instructions into cache to increase access speed. One or more cache lines may then be loaded into a special purpose register file for execution by the processor. When referring to the functionality of a software module below, it will be understood that such functionality is implemented by the processor when executing instructions from that software module. Furthermore, it should be appreciated that aspects of the present disclosure result in improvements to the functioning of the processor, computer, machine, or other system implementing such aspects.

If implemented in software, the functions may be stored or transmitted over as one or more instructions or code on a computer-readable medium. Computer-readable media include both computer storage media and communication media including any storage medium that facilitates transfer of a computer program from one place to another.

Further, it will be appreciated that modules and/or other appropriate means for performing the methods and techniques described herein can be downloaded and/or otherwise obtained by a user terminal and/or base station as applicable. For example, such a device can be coupled to a server to facilitate the transfer of means for performing the methods described herein. Alternatively, various methods described herein can be provided via storage means, such that a user terminal and/or base station can obtain the various methods upon coupling or providing the storage means to the device. Moreover, any other suitable technique for providing the methods and techniques described herein to a device can be utilized.

It is to be understood that the claims are not limited to the precise configuration and components illustrated above. Various modifications, changes, and variations may be made in the arrangement, operation, and details of the methods and apparatus described above without departing from the scope of the claims. The matter set forth in the foregoing description and accompanying drawings is offered by way of illustration only and not as a limitation. While particular embodiments have been shown and described, it will be apparent to those skilled in the art that changes and modifications may be made without departing from the broader aspects of the inventors' contribution. The actual scope of the protection sought is intended to be defined in the following claims when viewed in their proper perspective based on the prior art.

The word "exemplary" is used herein to mean "serving as an example, instance, or illustration." Any aspect described herein as "exemplary" is not necessarily to be construed as preferred or advantageous over other aspects.

As used herein, the term "coupled" and its functional equivalents are not intended to necessarily be limited to direct, mechanical coupling of two or more components. Instead, the term "coupled," and its functional equivalents, are intended to mean any direct or indirect mechanical, electrical, or chemical connection between two or more objects, features, work pieces, and/or environmental matter. "Coupled" is also intended to mean, in some examples, one object being integral with another object. Further, coupling can include, and is not limited to, using adhesives, pinned connections, welding, or any other securing method.

What is claimed is:

1. A tool storage unit comprising:

a body;

translatable bins having respective interiors, wherein each bin is disposed in the body and movable between opened and closed positions relative to the body;

a sensor disposed on the body and adapted to detect a first event, the first event includes a proximity detection of a person or an object and movement of at least one of the translatable bins to the opened position;

a light adapted to illuminate the interior of the at least one of the translatable bins when the at least one of the bins is disposed in the opened position;

a processor operably coupled to the sensor and the light and configured to generate an alert upon detection of the first event, wherein the alert causes the light to be changed from an OFF state to an ON state.

2. The tool storage unit of claim 1, wherein the alert causes the light to be illuminated for a period of time.

3. The tool storage unit of claim 1, wherein the processor is configured to cause the light to be changed from the ON state to the OFF state upon detection of a second event.

4. The tool storage unit of claim 3, wherein the second event includes movement of the at least one of the translatable bins to the closed position or ceasing the proximity detection of the person or an object.

5. The tool storage unit of claim 1, wherein the alert further includes actuating a lock.

6. The tool storage unit of claim 5, wherein the alert further includes actuating the lock to an unlocked position upon the proximity detection of the person or object.

7. The tool storage unit of claim 6, wherein the alert includes actuating the lock to a locked position upon expiration of the proximity detection.

8. The tool storage unit of claim 1, wherein the sensor includes an optical sensor disposed proximate to a top of the tool storage unit.

9. The tool storage unit of claim 1, wherein the first event includes an interruption of a cone of visibility of the sensor.

10. The tool storage unit of claim 1, wherein the sensor includes at least one of an infrared sensor, a laser range finder, an optical gate switch, a sonar, a microphone, a hall effect sensor, a magnetic reed switch, a tunneling magnetic resistance, a radio frequency transmitter, a gyroscope, an accelerometer, a capacitor, or a push/pull switch.

11. The tool storage unit of claim 1, wherein the alert is an audio signal.

12. The tool storage unit of claim 1, wherein the sensor includes a transmitter and a receiver, and wherein the first event includes an intervening object disposed between the transmitter and receiver.

13. The tool storage unit of claim 12, wherein the transmitter and receiver are disposed vertically across the translatable bins.

14. The tool storage unit of claim 12 wherein the transmitter and receiver are disposed horizontally across the translatable bins.

15. An interactive tool storage system for a storage unit having a translatable bin disposed in the storage unit and movable between opened and closed positions relative to the storage unit and a light adapted to illuminate an interior of the bin, comprising:

a user interface;

a sensor system configured to detect an event associated with the storage unit;

a communication module;

a power module;

a data processing system operably coupled to the user interface, the light, the sensor system, the communication module, and the power module, and wherein the data processing system includes a processor configured to:

receive a detection event from the sensor system, the detection event includes a proximity detection of a person or an object and movement of the bin to the opened position;

generate an alert in response to the detection event, the alert causes the light to be changed from an OFF state to an ON state; and transmit the alert to the communication module.

16. A tool storage unit comprising:

a translatable bin disposed in the storage unit and movable between opened and closed positions relative to the storage unit;

a first sensor configured to detect movement of the bin;

a proximity sensor configured to detect the proximity of a person or an object relative to the tool storage unit;

a light disposed above the bin and adapted to illuminate an interior of the bin when the bin is disposed in the opened position;

a processor configured to generate an alert upon detection of movement of the bin and an object or person in proximity to the unit, the alert causing the light to be changed from an OFF state to an ON state.

17. The tool storage unit of claim 1, further comprising an inertial measurement unit adapted to measure a change of inertia caused by moving the at least one of the translatable bins, wherein the processor determines if the at least one of the translatable bins is disposed in the opened position based on the measured inertia.

18. The interactive tool storage system of claim 15, wherein the sensor system includes an inertial measurement unit adapted to measure a change of inertia caused by moving the bin, wherein the processor determines if the bin is disposed in the opened position based on the measured inertia.

19. The tool storage unit of claim 16, further comprising an inertial measurement unit adapted to measure a change of inertia caused by moving the bin, wherein the processor determines if the bin is disposed in the opened position based on the measured inertia.

* * * * *